US006709283B2

(12) United States Patent
Lai

(10) Patent No.: US 6,709,283 B2
(45) Date of Patent: Mar. 23, 2004

(54) CARD CONNECTOR DEVICE HAVING DAUGHTER BOARD RETAINER

(75) Inventor: Chih Ming Lai, Taipei (TW)

(73) Assignee: Giga-Byte Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/327,004

(22) Filed: Dec. 24, 2002

(65) Prior Publication Data

US 2003/0129860 A1 Jul. 10, 2003

(30) Foreign Application Priority Data

Jan. 4, 2002 (TW) ..... 91200089 U

(51) Int. Cl.[7] ..... H01R 13/62
(52) U.S. Cl. ..... 439/327; 439/153
(58) Field of Search ..... 439/327, 325, 439/153, 157, 160, 152

(56) References Cited

U.S. PATENT DOCUMENTS 4,579,411 A * 4/1986 Cobaugh et al. ..... 439/327
5,650,917 A * 7/1997 Hsu ..... 439/327
6,210,195 B1 * 4/2001 Ma ..... 439/327
6,379,168 B1 * 4/2002 Wang ..... 439/160
6,551,120 B2 * 4/2003 Daskalakis et al. ..... 439/157

* cited by examiner

*Primary Examiner*—Tho D. Ta
(74) *Attorney, Agent, or Firm*—Rosenberg, Klein & Lee

(57) ABSTRACT

A connector device includes a housing mounted on a mother board and having a slot for receiving a daughter board. A retainer is used for securing the daughter board to the housing, and includes a support having a channel for receiving the daughter board, and a latch slidably received in a base and to be maintained relative to the base at either a working position to engage with the daughter board, or a non-working position to disengage from the daughter board. The daughter board may be easily engaged into the housing when the latch is located at the non-working position.

12 Claims, 11 Drawing Sheets

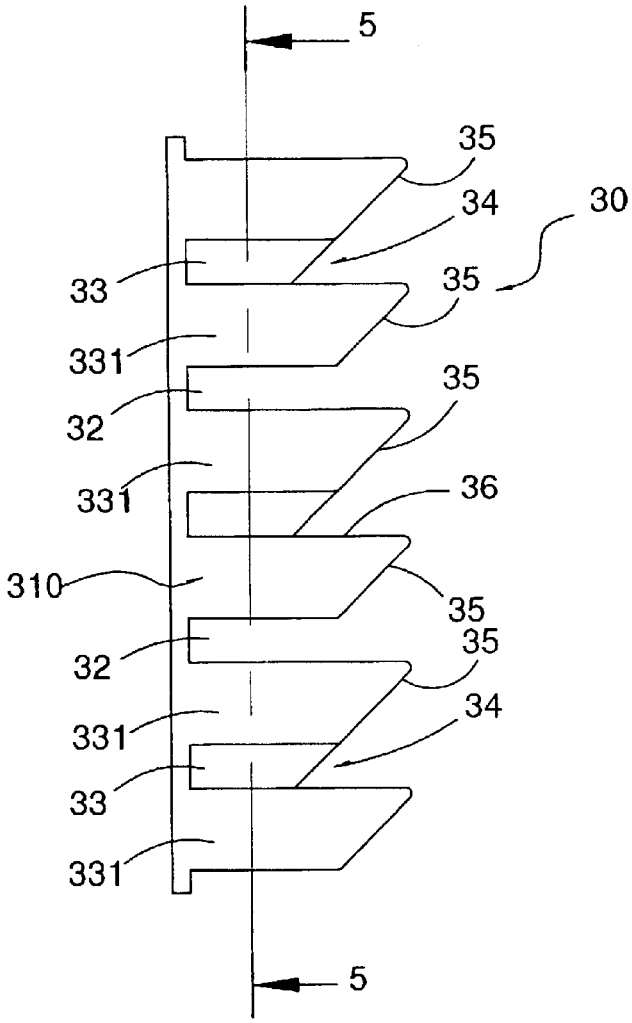
FIG. 4
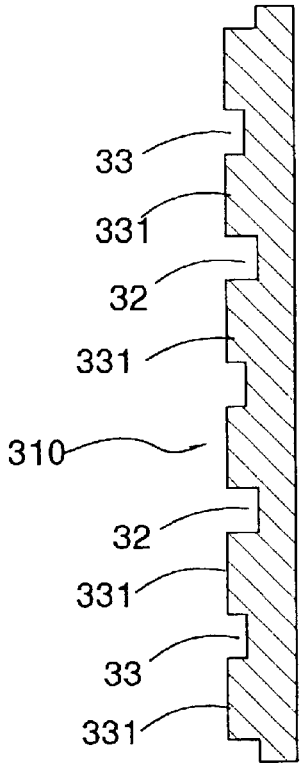
FFIG. 5

CARD CONNECTOR DEVICE HAVING DAUGHTER BOARD RETAINER

BACKGROUND OF THE INVENTION

1. Field of the Invention

The present invention relates to a connector device, and more particularly to a card connector device having a retainer for solidly and effectively retaining or latching daughter boards to mother boards.

2. Description of the Prior Art

Typical card connector devices have been provided for securing daughter boards to mother boards. One of the typical card connector devices is disclosed in U.S. Pat. No. 6,368,124 to Wang, and comprises a retention arm having a latch projection for engaging with and for locking the daughter board to a housing of the card connector device.

However, the retention arm is formed integral with the housing with molding processes. When the card connector device is formed or manufactured with a softer material, the retention arm will have no suitable resilience to retain or to latch the daughter board to the housing.

On the contrary, when the card connector device is formed or manufactured with a relatively harder or stronger material, the daughter board may not easily move over or beyond the retention arm, and the retention arm may have a good chance to be broken by the users when the retention arm is bent relative to the housing.

The present invention has arisen to mitigate and/or obviate the afore-described disadvantages of the conventional card connector devices.

SUMMARY OF THE INVENTION

The primary objective of the present invention is to provide a card connector device including a retainer for solidly and effectively retaining or latching daughter boards to mother boards.

The other objective of the present invention is to provide a card connector device including a retainer for allowing daughter boards to be secured or latched to mother boards by users.

In accordance with one aspect of the invention, there is provided a connector device comprising a mother board, an elongate housing mounted on the mother board, and including an elongate slot formed therein, a daughter board selectively engageable into the slot of the housing, and a retainer for securing the daughter board to the housing. The retainer includes a support having a channel formed therein for receiving the daughter board, and including a base having a bore formed therein, and including a latch slidably received in the bore of the base. The retainer includes a maintaining device for selectively maintaining the latch at a working position to engage with the daughter board, and at a non-working position to disengage from the daughter board.

The selectively maintaining device includes a plurality of seats provided in the base, for selectively supporting the latch at the working position. The base includes a plurality of grooves and passages alternatively formed therein and having different depths, and the seats are aligned with the passages of the base.

The base includes a plurality of swellings defined between the grooves and the passages thereof. The swellings each includes a first end having an inclined surface formed therein, and inclined toward the seats of the base respectively.

The selectively maintaining device includes a rotary member provided on one end of the latch, and having at least one rib extended therefrom and slidably receivable in the grooves of the base when the latch is maintained at the non-working position, and seated on one of the seats when the latch is maintained at the working position.

The rib includes one end having an inclined surface formed therein for engaging with the inclined surfaces of the swellings.

The rotary member includes a bore formed therein for receiving the one end of the latch.

The selectively maintaining device includes a knob engaged with the rotary member for moving the latch to the working position when the knob is depressed into the base. The rotary member includes a first end having a plurality of teeth formed therein, and the knob includes a first end having a plurality of teeth formed therein and engaged with the teeth of the rotary member. The knob includes a plurality of juts extended therefrom and slidably received in the grooves and the passages of the base respectively.

A spring biasing device may be used for biasing the latch away from the daughter board.

A cap may be secured to a first end of the base for retaining the latch in the base. The base includes at least one depression formed in the first end thereof, the cap includes at least one projection extended therefrom and engaged into the depression of the base. The base includes at least one protrusion bendable to engage with the projection of the cap, and to secure the cap to the base.

Further objectives and advantages of the present invention will become apparent from a careful reading of a detailed description provided hereinbelow, with appropriate reference to accompanying drawings.

BRIEF DESCRIPTION OF THE DRAWINGS

FIG. 4 is a partial plan view illustrating the spread out of the inner peripheral surface of a base of the card connector device;

FIG. 5 is a partial cross sectional view taken along lines 5—5 of FIG. 4;

DETAILED DESCRIPTION OF THE PREFERRED EMBODIMENT

Figure 1:
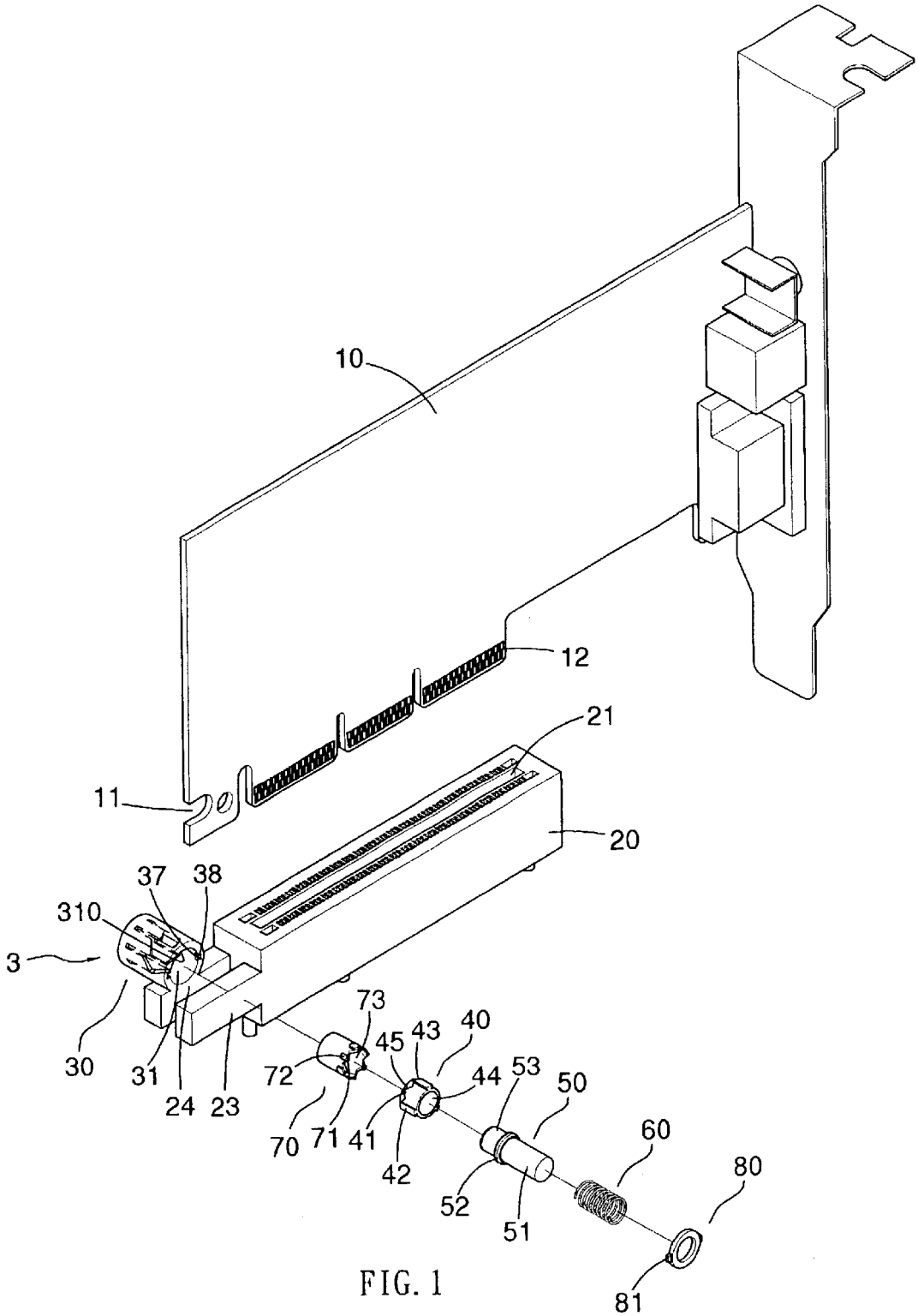
FIG. 1 is an exploded view of a card connector device in accordance with the present invention.
Figure 2:
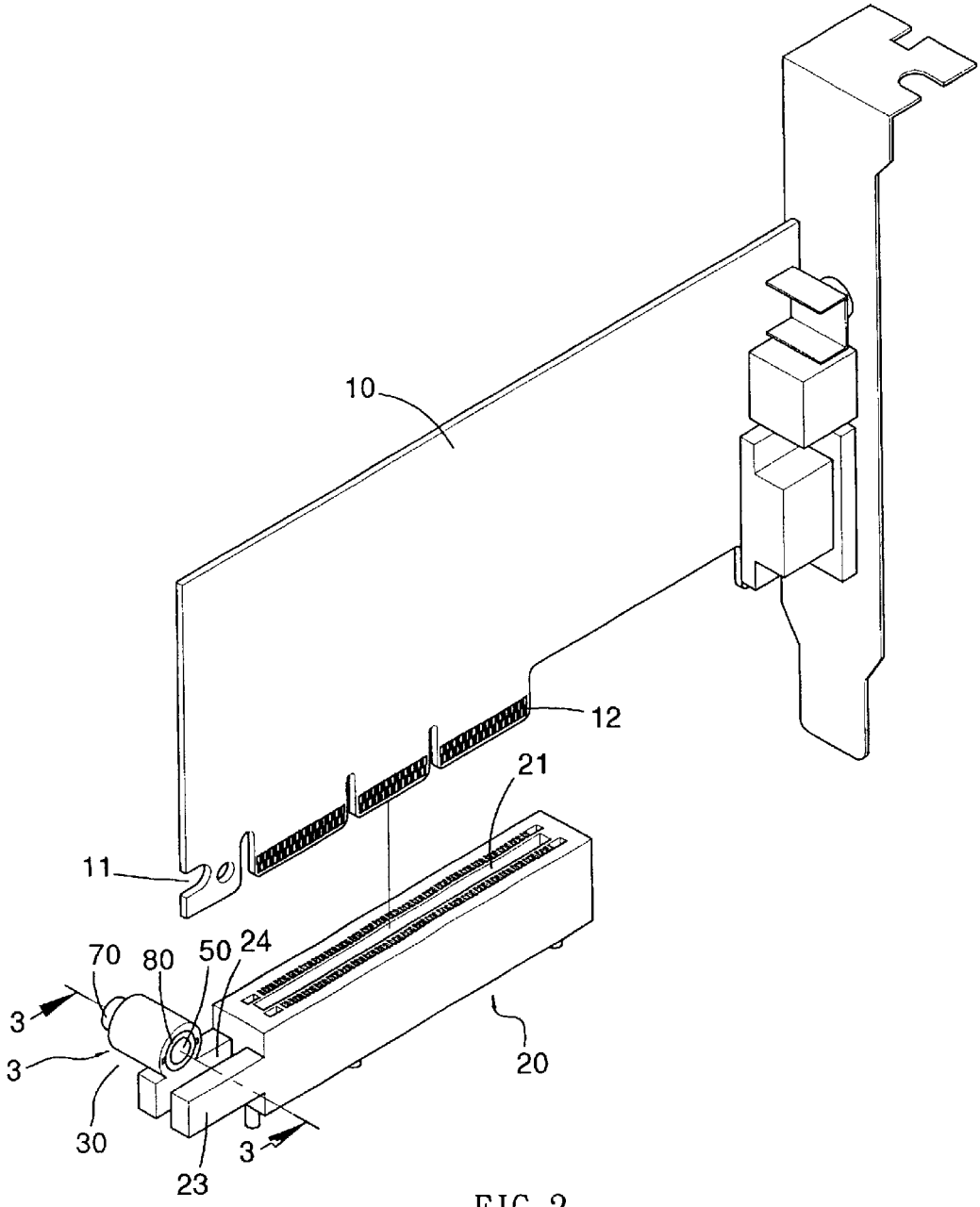
FIG. 2 is a partial exploded view of the card connector device.
Figure 3:
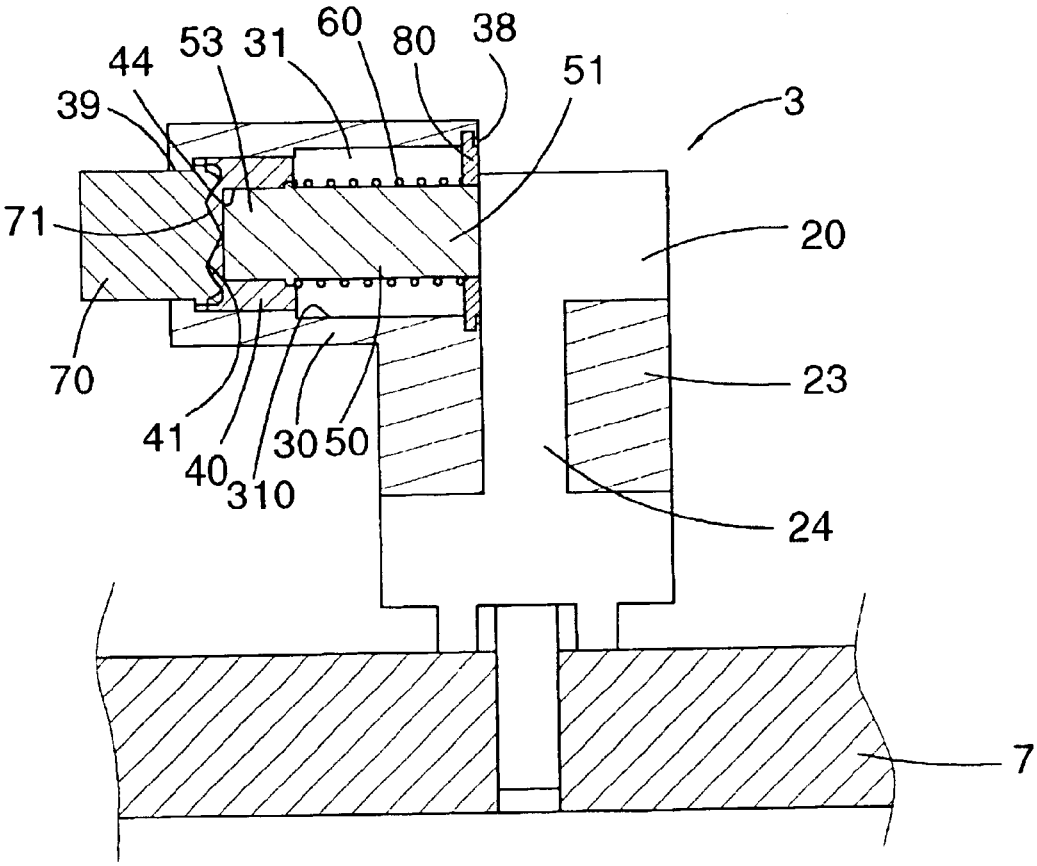
FIG. 3 is a cross sectional view taken along lines 3—3 of FIG. 2.

Referring to the drawings, and initially to FIGS. 1–3, a card connector device in accordance with the present invention comprises a daughter board 10 to be attached to a mother board 7 with an elongated housing 20 and a retainer 3. For example, the elongated housing 20 is mounted onto the mother board 7 and includes an elongate slot 21 formed therein for receiving the daughter board 10 therein.

The elongated housing 20 includes a number of typical conductive members (not shown) for electrically coupled to the corresponding conductive members 12 of the daughter board 10.

However, the coupling of the conductive members 12 of the daughter board 10 and of the elongated housing 20 is not related to the present invention and will not be described in further details.

The retainer 3 is further provided for retaining or securing the daughter board 10 to the housing 20 and/or to the mother board 7. For example, the retainer 3 may be formed integral or attached or secured to one end of the elongated housing 20, or secured to the mother board 7, and for securing the daughter board 10 to the housing 20 and/or the mother board 7.

Figure 8:
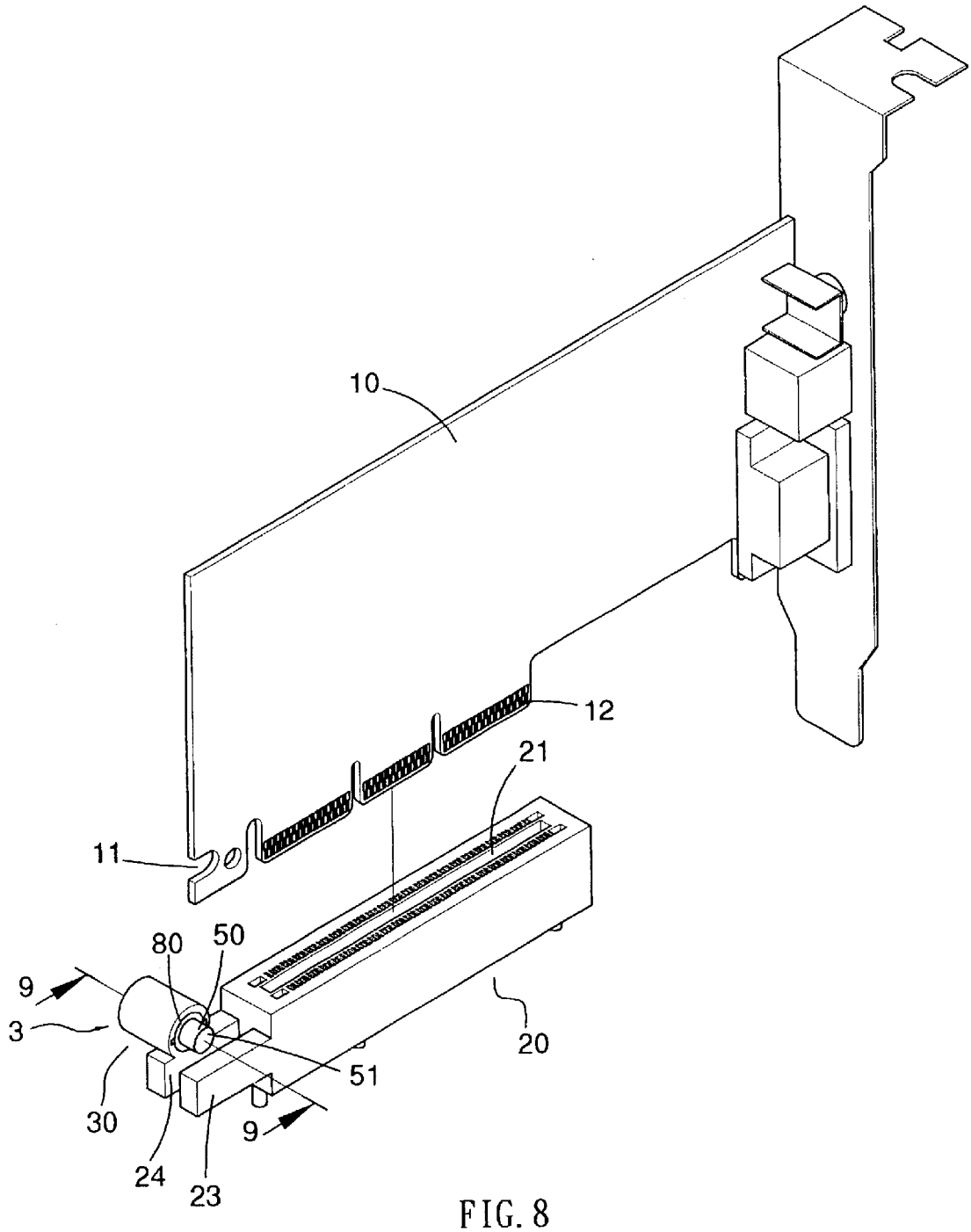
FIG. 8 is a partial exploded view similar to FIG. 2, illustrating the operation of the card connector device.

The retainer 3 includes a support 23 either secured to the elongated housing 20 or directly secured to the mother board 7, and having a channel 24 formed therein for receiving a portion or an edge of the daughter board 10 (FIGS. 1, 2, 8). The retainer 3 includes a base 30 provided or secured on the support 23, and having a bore 31 formed therein.

The base 30 includes one end having one or more depressions 37 formed therein, and communicating with the bore 31 thereof, and having one or more protrusions 38 extended therefrom and located beside the depressions 37 thereof respectively; and includes a peripheral flange 39 extended radially into the bore 31 thereof from the other end thereof (FIGS. 3, 9, 13, 14).

The base 30 includes an inner peripheral surface 310 formed therein for defining the bore 31 thereof, and includes a number of grooves 32 and passages 33 having different depths, and alternatively formed in the inner peripheral surface 310 thereof, best shown in FIGS. 4, 5, for forming or defining a number of swellings 331 between the grooves 32 and the passages 33 thereof.

The swellings 331 each includes a straight side or edge 36 formed on one side thereof, and each includes a free end having an angled or inclined surface 35 formed therein and inclined toward the other side thereof. As best shown in FIG. 5, the passages 33 of the base 30 each includes a shallower or smaller depth than that of the grooves 32 of the base 30, such that a seat 34 may be formed in one end of each passage 33 of the base 30 or aligned with the passage 33 of the base 30, and located in the bottom or the root portion of the inclined surface 35 of the respective swelling 331, or located closer to the channel 24 of the support 23.

A latch 50 is slidably received in the bore 31 of the base 30, and includes one end 51 extendible out of one end of the base 30, and extendible into the channel 24 of the support 23 or of the elongate housing 20 (FIGS. 8, 9), for engaging into an opening 11 of the daughter board 10, and thus for latching and securing the daughter board 10 to the housing 20 and thus to the mother board 7.

A cap 80 is engaged into one end of the bore 31 of the base 30, and includes one or more projections 81 radially extended therefrom and engaged into the depressions 37 of the base 30 respectively. The protrusions 38 of the base 30 may then be bent or forged relative to the base 30 to engage with the respective projections 81 of the cap 80, in order to secure the cap 80 to the base 30 (FIGS. 3, 9).

Figure 9:
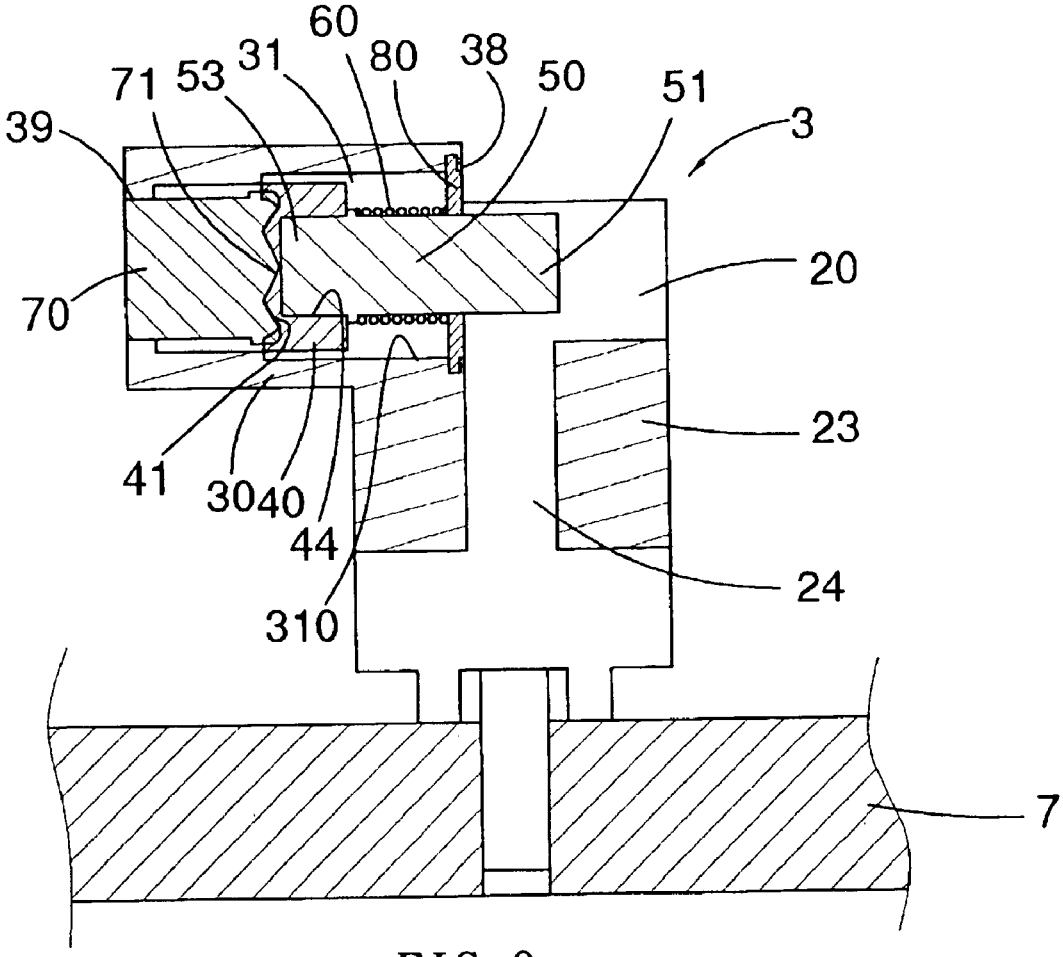
FIG. 9 is a cross sectional view taken along lines 9—9 of FIG. 8.

As also shown in FIGS. 3, 9, a spring 60 is engaged onto the latch 50 and engaged between a peripheral stop 52 of the latch 50 and the cap 80 or the base 30, for biasing the one end 51 of the latch 50 into the bore 31 of the base 30, and for disengaging the one end 51 of the latch 50 from the channel 24 of the support 23 of the retainer 3 or of the housing 20 (FIG. 3).

Figure 7:
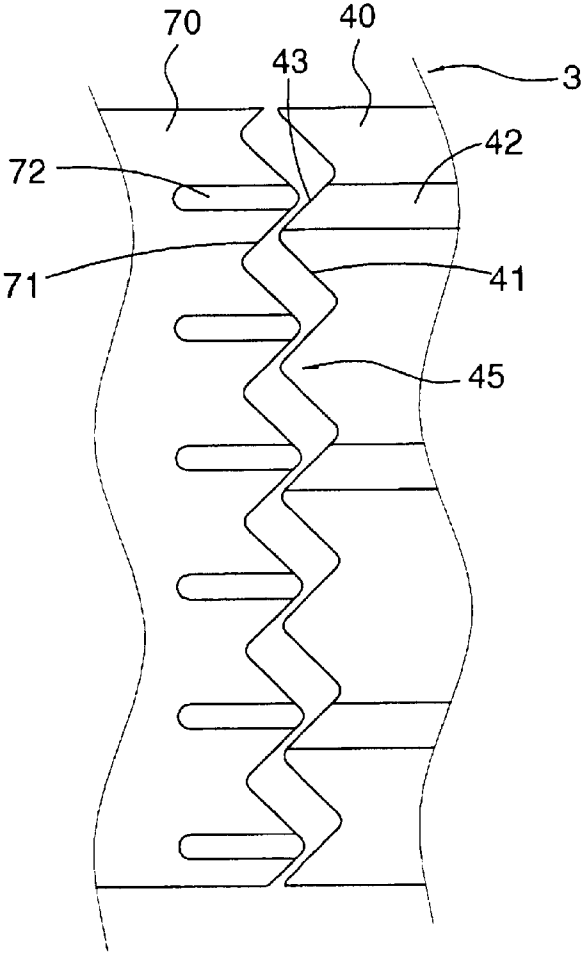
FIGS. 6, 7 are partial plan views illustrating the spread out of the outer peripheral surfaces of two actuator members of the card connector device.
Figure 6:
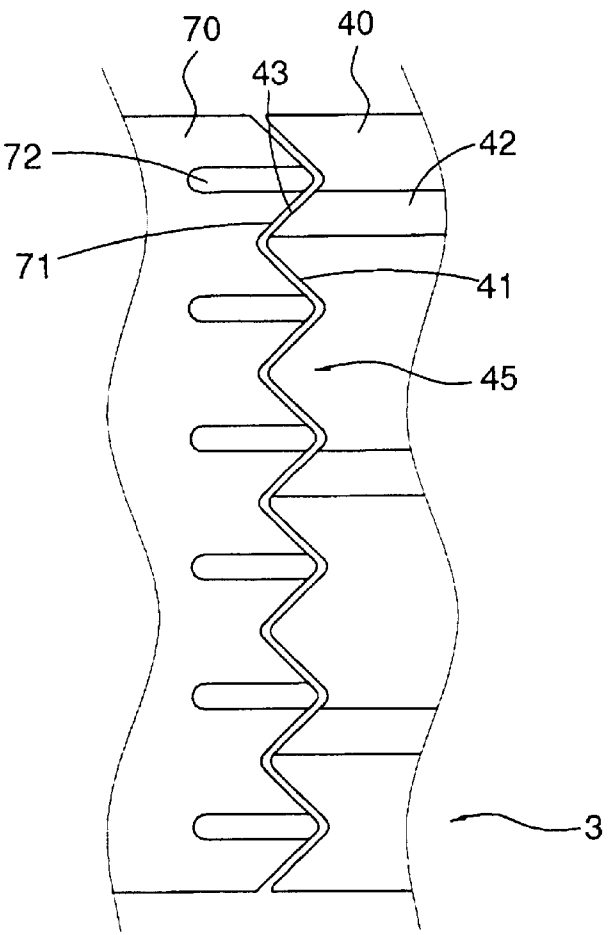

As best shown in FIGS. 2, 4 and 5, the other end 53 of the latch 50 is rotatably engaged into a bore 44 of a rotary member 40 which is rotatably received in the bore 31 of the base 30 (FIGS. 3, 9). As shown in FIGS. 6, 7, the rotary member 40 includes a number of teeth 41 formed in one end 45 of the rotary member 40, and a number of longitudinal ribs 42 formed in the outer peripheral portion thereof.

Figure 11:
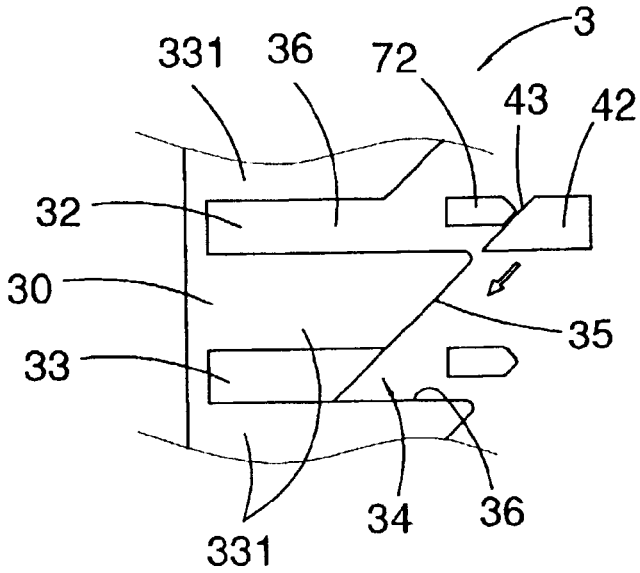
Figure 12:
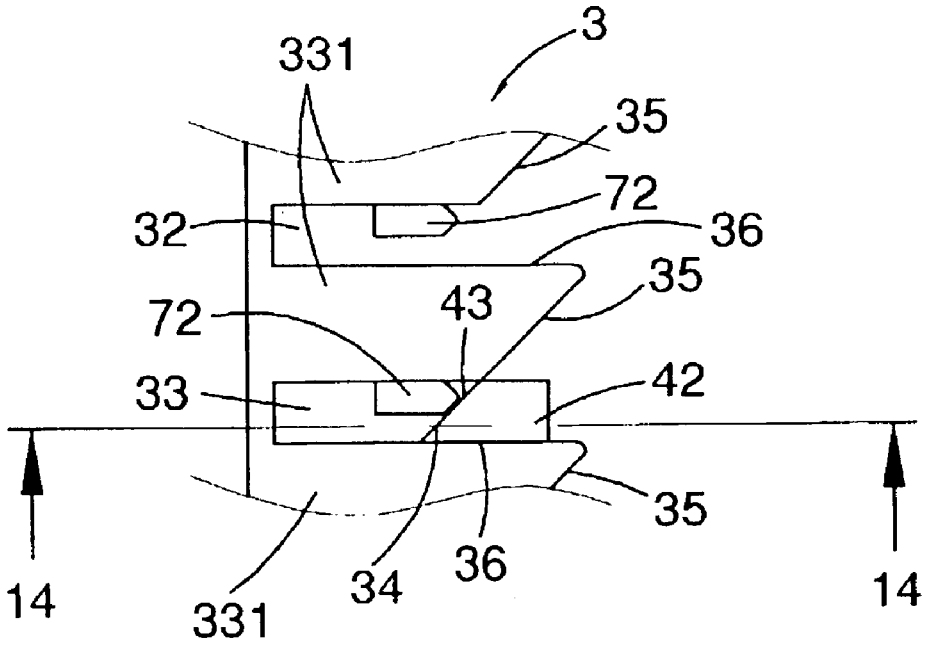
Figure 13:
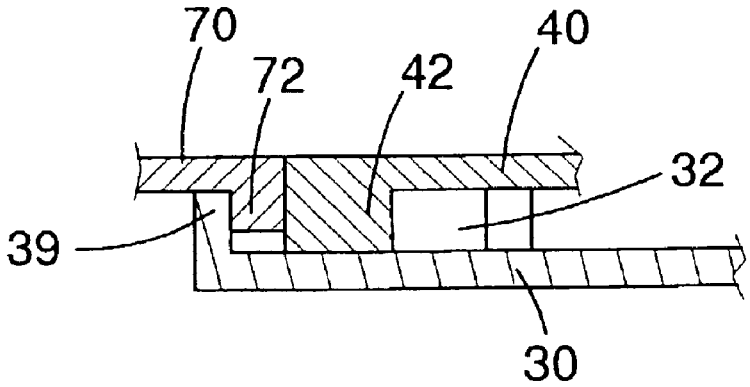
FIGS. 13, 14 are partial cross sectional views taken along lines 13—13, and 14—14 of FIGS. 10 and 12 respectively.

The ribs 42 are aligned with one side or one half of the respective teeth 41, best shown in FIGS. 6, 7, and each includes an inclined surface 43 formed in one end or free end thereof and aligned with or flush with the corresponding inclined surfaces of the teeth 41, for engaging with the inclined surfaces 35 of the swellings 331 of the base 30 (FIGS. 11, 12).

A knob 70 is slidably received in the bore 31 of the base 30, and has one end extendible out of the base 30 (FIGS. 2, 3), and has a bore 73 formed in the other end thereof for rotatably receiving the end 45 of the rotary member 40. The knob 70 includes a number of teeth 71 formed or provided on the other end thereof for engaging with the teeth 41 of the rotary member 40, and includes a number of juts 72 extended out from the outer peripheral portion thereof, and slidably received in either the grooves 32 or the passages 33 of the base 30.

As best shown in FIG. 6, the juts 72 of the knob 70 are aligned with the middle or center portions of the respective teeth 71 of the knob 70, and thus may be offset from the ribs 42 of the rotary member 40 respectively when the teeth 41, 71 of the rotary member 40 and the knob 70 are engaged with each other. It is preferable that the ribs 42 include a width greater than that of the juts 72, for allowing the inclined surfaces 43 of the ribs 42 to be engaged with the inclined surfaces 35 of the base 30 (FIG. 11).

Figure 10:
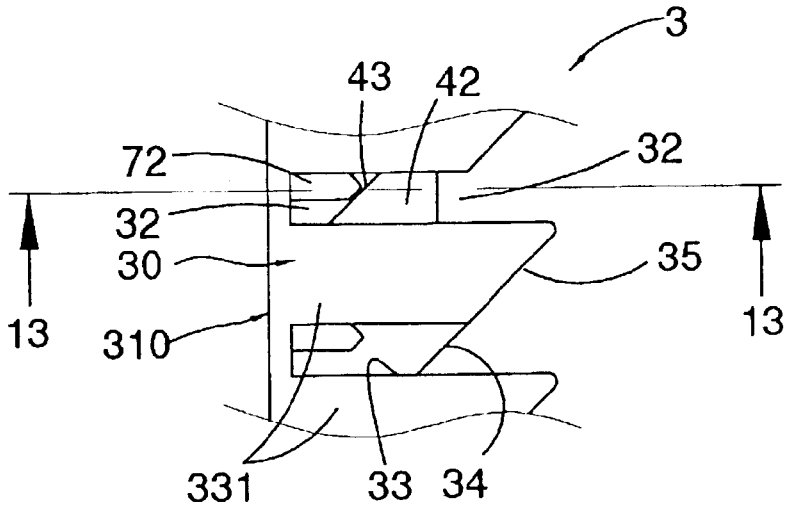
FIGS. 10, 11, 12 are partial plan views illustrating the operation of the card connector device.

In operation, as shown in FIGS. 3, 6, and 10, the one end 51 of the latch 50 may be biased into the bore 31 of the base 30 by the spring 60 (FIG. 3), and the ribs 42 of the rotary member 40 and the juts 72 of the knob 70 may be engaged into or received in the grooves 32 of the base 30 (FIG. 10), and the teeth 41, 71 of the rotary member 40 and the knob 70 may be biased to engage with each other by the spring 60 (FIG. 6).

At this moment, the latch 50 is moved into the base 30 in a storing or non-working position, such that the daughter board 10 may be easily engaged into the slot 21 of the housing 20 and the channel 24 of the support 23 or of the housing 20.

As shown in FIGS. 8 and 9, when the knob 70 is depressed toward or into the base 30 against the spring 60, the ribs 42 of the rotary member 40 may be moved along the straight edges 36 of the swellings 331 until the ribs 42 are disengaged from the swellings 331, as shown in FIG. 11.

Figure 14:
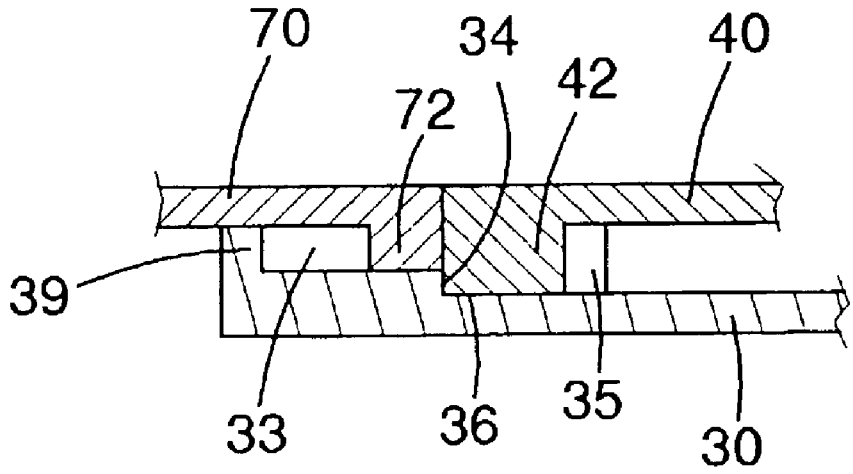

When the inclined surfaces 43 of the ribs 42 are aligned with the inclined surfaces 35 of the base 30, the rotary member 40 may be biased, by the spring 60, toward the peripheral flange 39 of the base 30, such that the inclined surfaces 43 of the ribs 42 may be forced to move along the inclined surfaces 35 of the base 30, until the ribs 42 are supported or seated on the respective seats 34 of the base 30, as shown in FIGS. 12, 14.

At this moment, or when the ribs 42 are supported on the respective seats 34 of the base 30, the end 51 of the latch 50 is moved or extended out of the base 30 in a working position (FIG. 9) and may thus be engaged into the opening 11 of the daughter board 10, such that the daughter board 10 may be secured or locked to the support 23 and/or the housing 20, and thus be locked to the mother board 7.

When the daughter board 10 is required to be disengaged from the housing 20, the knob 70 may be depressed toward or into the base 30 against the spring 60, until the ribs 42 are disengaged from the swellings 331 again, as shown in FIG. 11. The rotary member 40 may then be biased, by the spring 60 again, toward the peripheral flange 39 of the base 30, and the inclined surfaces 43 of the ribs 42 may also be forced to move along the inclined surfaces 35 of the base 30, until the ribs 42 are engaged into the respective grooves 32 of the base 30 again, as shown in FIGS. 10, 11.

At this moment, the latch 50 may be moved into the base 30 again in the storing or non-working position, such that the daughter board 10 may be easily engaged into the slot 21 of the housing 20 and the channel 24 of the support 23 or of the housing 20.

It is to be noted that the ribs 42 may be engaged into the respective grooves 32 of the base 30, and the latch 50 may be moved into the base 30 at the storing or non-working position, such that the daughter board 10 may be easily engaged into or disengaged from the slot 21 of the housing 20 and the channel 24 of the support 23 or of the housing 20, without actuating the knob 70, such that the user may have both of his hands to engage the daughter board 10 into the housing 20.

Figure 15:
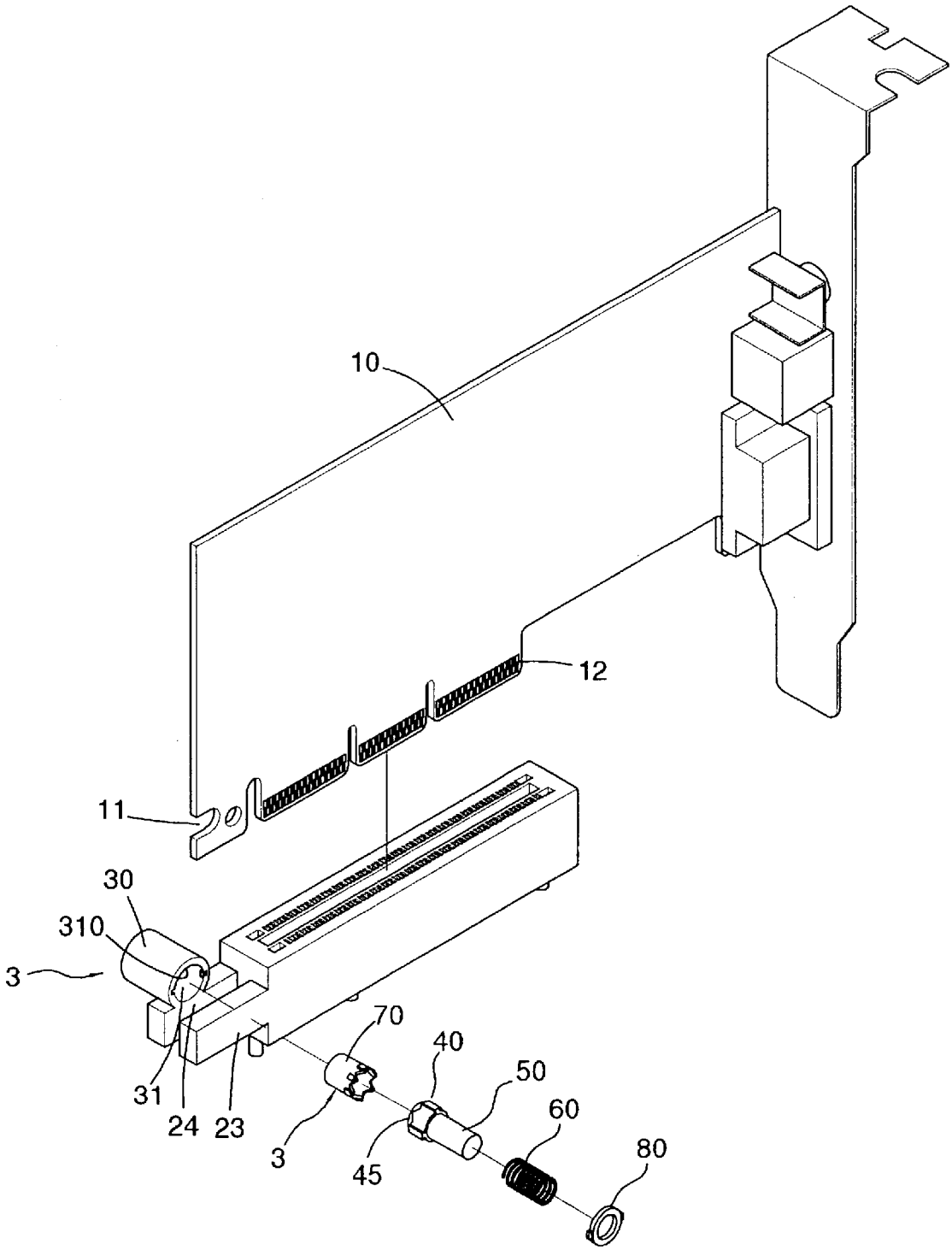
FIG. 15 is a partial exploded view illustrating another embodiment of the card connector device.

Alternatively, as shown in FIG. 15, the rotary member 40 may be formed integral with the latch 50, such that the latch 50 may be rotated in concert with the rotary member 40 relative to the base 30.

Accordingly, the card connector device in accordance with the present invention includes a retainer having a latch slidably relative to the base or the housing for solidly and effectively retaining or latching daughter boards to the housing and/or to the mother boards. The latch may be maintained in either a working or a non-working position relative to the housing or the daughter board.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A connector device comprising:

a mother board, an elongate housing mounted on said mother board, and including an elongate slot formed therein, a daughter board selectively engageable into said slot of said housing, a retainer for securing said daughter board to said housing, said retainer including a support having a channel formed therein for receiving said daughter board, and including a base having a bore formed therein, and including a latch slidably received in said bore of said base, said base including a plurality of grooves and passages alternatively formed therein and having different depths, and said retainer including means for selectively maintaining said latch at a working position to engage with said daughter board, and at a non-working position to disengage from said daughter board, said selectively maintaining means including a plurality of seats provided in said base, for selectively supporting said latch at said working position and said seats are aligned with said passages of said base.

2. The connector device according to claim 1, wherein said base includes a plurality of swellings defined between said grooves and said passages thereof.

3. The connector device according to claim 2, wherein said swellings each includes a first end having an inclined surface formed therein, and inclined toward said seats of said base respectively.

4. The connector device according to claim 3, wherein said selectively maintaining means includes a rotary member provided on one end of said latch, and having at least one rib extended therefrom and slidably receivable in said grooves of said base when said latch is maintained at said non-working position, and seated on one of said seats when said latch is maintained at said working position.

5. The connector device according to claim 4, wherein said at least one rib includes one end having an inclined surface formed therein for engaging with said inclined surfaces of said swellings.

6. The connector device according to claim 4, wherein said rotary member includes a bore formed therein for receiving said one end of said latch.

7. The connector device according to claim 4, wherein said selectively maintaining means includes a knob engaged with said rotary member for moving said latch to said working position when said knob is depressed into said base.

8. The connector device according to claim 7, wherein said rotary member includes a first end having a plurality of teeth formed therein, and said knob includes a first end having a plurality of teeth formed therein and engaged with said teeth of said rotary member.

9. The connector device according to claim 7, wherein said knob includes a plurality of juts extended therefrom and slidably received in said grooves and said passages of said base respectively.

10. A connector device comprising:

a mother board, an elongate housing mounted on said mother board, and including an elongate slot formed therein, a daughter board selectively engageable into said slot of said housing, a retainer for securing said daughter board to said housing, said retainer including a support having a channel formed therein for receiving said daughter board, and including a base having a bore formed therein, and including a latch slidably received in said bore of said base, said retainer including means for selectively maintaining said latch at a working position to engage with said daughter board, and at a non-working position to disengage from said daughter board, and means for biasing said latch away from said daughter board.

11. A connector device comprising:

a mother board, an elongate housing mounted on said mother board, and including an elongate slot formed therein, a daughter board selectively engageable into said slot of said housing, a retainer for securing said daughter board to said housing, said retainer including a support having a channel formed therein for receiving said daughter board, and including a base having a bore formed therein, and including a latch slidably received in said bore of said base, said base including a first end, a cap secured to said first end of said base for retaining said latch in said base and at least one depression formed in said first end thereof, said cap including at least one projection extended therefrom and engaged into said at least one depression of said base, and said retainer including means for selectively maintaining said latch at a working position to engage with said daughter board, and at a non-working position to disengage from said daughter board.

12. The connector device according to claim 11, wherein said base includes at least one protrusion bendable to engage with said at least one projection of said cap, and to secure said cap to said base.

* * * * *